US009000286B2

(12) United States Patent
Behringer et al.

(10) Patent No.: US 9,000,286 B2
(45) **Date of Patent: *Apr. 7, 2015**

(54) TOUCH SCREEN GUITAR

(71) Applicant: MUSIC Group IP, Ltd., Tortola (VG)

(72) Inventors: Ulrich Behringer, Makati (PH); Brian Crouch, Bothell, WA (US)

(73) Assignee: MUSIC Group IP Ltd., Tortola (VG)

( * ) Notice: Subject to any disclaimer, the term of this patent is extended or adjusted under 35 U.S.C. 154(b) by 0 days.

This patent is subject to a terminal disclaimer.

(21) Appl. No.: 14/225,156

(22) Filed: Mar. 25, 2014

(65) Prior Publication Data

US 2014/0202315 A1 Jul. 24, 2014

Related U.S. Application Data

(63) Continuation of application No. 13/698,261, filed as application No. PCT/PH2011/000006 on May 18, 2011, now Pat. No. 8,710,346, which is a continuation of application No. 12/782,044, filed on May 18, 2010, now Pat. No. 8,093,486.

(51) Int. Cl.
*G10H 1/32* (2006.01)
*G10H 1/18* (2006.01)
(Continued)

(52) U.S. Cl.
CPC ..... *G10H 1/18* (2013.01); *G10H 1/0008* (2013.01); *G10H 1/342* (2013.01); *G10H 2220/096* (2013.01); *G10H 2230/015* (2013.01); *G10H 2230/135* (2013.01)

(58) Field of Classification Search
CPC ..... G10H 2230/015; G10H 2220/096; G10H 1/342
USPC ..... 84/600, 644, 615, 653
See application file for complete search history.

(56) References Cited

U.S. PATENT DOCUMENTS 5,025,703 A 6/1991 Iba et al.
5,121,669 A 6/1992 Iba et al.
(Continued)

FOREIGN PATENT DOCUMENTS

EP 2 130 570 A1 12/2009
KR 10-2011-0136384 A 12/2011
WO 2009/111815 A1 9/2009

OTHER PUBLICATIONS

Civil Docket for Case #: 0:12-cv-60201-RNS, *Ion Audio, LLC* v. *Music Group Services US, Inc. et al.*, filed Feb. 3, 2012, U.S. District Court, Southern District of Florida (ft. Lauderdale), dated Aug. 30, 2013, 19 pages.
(Continued)

*Primary Examiner* — Jeffrey Donels
(74) *Attorney, Agent, or Firm* — Seed IP Law Group PLLC

(57) ABSTRACT

A synthetic guitar includes a body, a neck extending from the body, and at least one touch sensor at the neck for indicating finger position of a user. The body has a receptacle for removably securing a tablet computer to the body. The tablet computer has a touch screen for indicating finger position of the user. A processor of the tablet computer is programmed to receive input signals from the touch sensor and the touch screen and to produce an output signal based at least partially on the input signals. The software can enable the synthetic guitar to be used as a music synthesizer or to be used as a video game controller. Synthetic guitar can also include a retainer for removably securing a portable media player to be used as an additional video display while playing the guitar.

28 Claims, 9 Drawing Sheets

(51) Int. Cl.

| | |
|---|---|
| ***G10H 1/00*** | (2006.01) |
| ***G10H 1/34*** | (2006.01) |

(56) References Cited

U.S. PATENT DOCUMENTS

| | | | | |
|---|---|---|---|---|
| 5,398,585 | A | 3/1995 | Starr | |
| 5,557,057 | A | 9/1996 | Starr | |
| 6,162,981 | A | 12/2000 | Newcomer et al. | |
| 6,191,348 | B1 | 2/2001 | Johnson | |
| 7,309,828 | B2 | 12/2007 | Ludwig | |
| 7,355,110 | B2 | 4/2008 | Nash | |
| 7,504,578 | B2 | 3/2009 | Lewry | |
| 7,541,536 | B2 | 6/2009 | Daniel | |
| 7,563,974 | B2 | 7/2009 | Ozaki et al. | |
| 7,714,220 | B2 | 5/2010 | Festejo | |
| 8,093,486 | B2 * | 1/2012 | Behringer et al. | 84/615 |
| 8,710,346 | B2 * | 4/2014 | Behringer et al. | 84/644 |
| 2002/0179470 | A1 | 12/2002 | Lee | |
| 2004/0118268 | A1 | 6/2004 | Ludwig | |
| 2005/0183566 | A1 | 8/2005 | Nash | |
| 2005/0252359 | A1 | 11/2005 | Cook | |
| 2007/0000375 | A1 | 1/2007 | Harrison, Jr. | |
| 2007/0131100 | A1 | 6/2007 | Daniel | |
| 2008/0271594 | A1 | 11/2008 | Starr | |
| 2009/0064849 | A1 | 3/2009 | Festejo | |
| 2009/0071314 | A1 | 3/2009 | Huwaldt | |
| 2009/0100992 | A1 | 4/2009 | Elion | |
| 2009/0126553 | A1 | 5/2009 | Murray | |
| 2009/0260508 | A1 | 10/2009 | Elion | |
| 2009/0312102 | A1 | 12/2009 | Oberg et al. | |
| 2010/0033426 | A1 | 2/2010 | Grant et al. | |
| 2010/0064883 | A1 * | 3/2010 | Gynes | 84/645 |
| 2010/0307314 | A1 | 12/2010 | Piccionelli et al. | |
| 2011/0005367 | A1 | 1/2011 | Hwang et al. | |
| 2011/0011248 | A1 | 1/2011 | Elion | |
| 2011/0088535 | A1 * | 4/2011 | Zarimis | 84/645 |
| 2012/0125180 | A1 * | 5/2012 | Shim | 84/666 |
| 2012/0204704 | A1 * | 8/2012 | Shim et al. | 84/645 |
| 2012/0297962 | A1 * | 11/2012 | O'Donnell et al. | 84/645 |
| 2012/0318121 | A1 * | 12/2012 | Mittelstadt et al. | 84/743 |
| 2013/0068086 | A1 * | 3/2013 | Mittelstadt et al. | 84/645 |
| 2013/0174717 | A1 * | 7/2013 | Butera et al. | 84/609 |

OTHER PUBLICATIONS

Kitara User Manual/EN, Misa Digital Instruments, 2011, 32 pages.

"Markvi_fan's photstream," flicker, retrieved from URL=http://www.flicker.com/photos/29701602@N03/, download date Nov. 2, 2012, 26 pages.

Kraft, "Hack Guitar Hero DS into a guitar controller," retrieved from URL=http://hackaday.com/2008/08/20/hack-guitar-hero-ds-into-a-guitar-controller/, publication date Aug. 20, 2008, retrieved on Jan. 24, 2013, 7 pages.

Ridden et al., "The i-Tab electronic songbook for guitarists," retrieved from URL=http://www.gizmag.com/itab-electronic-songbook/14357/, publication date Mar. 1, 210, retrieved Jan. 24, 2013, 5 pages.

* cited by examiner

TOUCH SCREEN GUITAR

TECHNICAL FIELD

The field of the present invention generally relates to musical instruments and, more particularly, to electronic musical instruments which are played like guitars.

BACKGROUND ART

Electronic musical instruments played like a guitar, also known as stringless guitars and synthetic guitars, are known. See, for example U.S. Pat. Nos. 5,398,585 and 5,557,057 and U.S. Patent Application Publication No. 2008/0271594, the disclosures of which are expressly incorporated herein in their entireties. These synthetic guitars typically have an array of switches in an elongated grid at a fret board area to simulate guitar strings for finger positioning of chords and the like and another array of switches at a sound board area to simulate strings for strumming and picking. The fret board switches are typically arranged in an elongated grid of, for example, six "strings" with a number of "fret" switches per "string", whereas the soundboard switches are typically arranged for convenient "strumming" action across an extended area.

Such synthetic guitars have proven to be popular with the public. These synthetic guitars, however, have relatively high production costs. One reason for the relatively high production cost is the quantity of switches that are needed to provide the various functions of musical play. Even greater acceptance and popularity could be achieved with improved performance, easier playing, and reduced cost.

Gaming peripherals that simulate guitar playing for musical video games are also known. See, for example, U.S. Patent Application Publication No. 2010/0033426, the disclosure of which is expressly incorporated herein in its entirety. These gaming peripherals or controllers typically have a limited number of switches at a fret board and a single switch at a soundboard area for strumming.

Such gaming peripherals and musical video games are extremely popular. These synthetic guitars, however, do not provide a very realistic experience of playing a guitar. Even greater acceptance and popularity could be achieved with a more realistic playing experience while maintaining relatively easy playing and relatively low cost. Accordingly, there is a need for improved synthetic guitars.

DISCLOSURE OF THE INVENTION

Disclosed are synthetic guitars which address one or more issues of the related art. Disclosed is a synthetic guitar comprising, in combination, a body, a neck extending from the body, at least one touch sensor at the neck for indicating finger position of a user, a touch screen at the body for indicating finger position of the user, and a processor. The processor receives input signals from the at least one touch sensor and the touch screen and produces an output signal based at least partially on the input signals from the at least one touch sensor and the touch screen.

Also disclosed is a synthetic guitar for use with a tablet computer having a processor and a touch screen. The synthetic guitar comprises, in combination, a body, a neck extending from the body, at least one touch sensor at the neck for indicating finger position of a user, and an electrical connector for electrically connecting the at least one touch sensor to the tablet computer. The body has a receptacle removably securing the tablet computer to the body. The processor receives input signal from the at least one touch sensor and the touch screen and produces an output signal based at least partially on the input signals from the at least one touch sensor and the touch screen.

From the foregoing disclosure and the following more detailed description of various preferred embodiments it will be apparent to those skilled in the art that the present invention provides a significant advance in the technology and art of synthetic guitars. Particularly significant in this regard is the potential the invention affords for providing a relatively low cost, versatile, and easy to use musical synthesizers which are played like a guitar additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
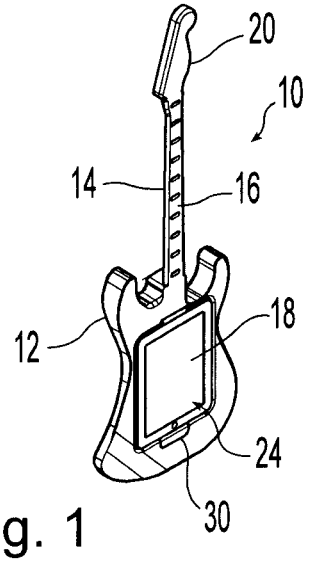
FIG. 1 is a perspective view of a synthetic guitar according to a first embodiment of the present invention.
Figure 2:
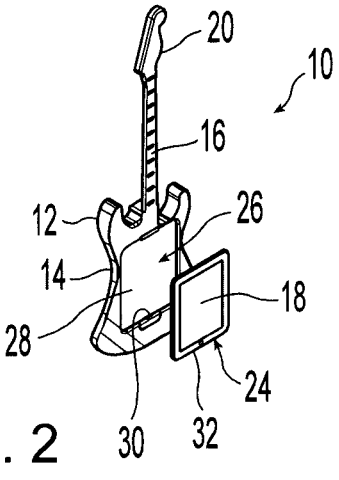
FIG. 2 is a partially-exploded view of the synthetic guitar of FIG. 1, wherein a table computer having a touch screen is removed.
Figure 4:
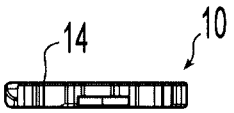
FIG. 4 is a top plan view of the synthetic guitar.
Figure 3:
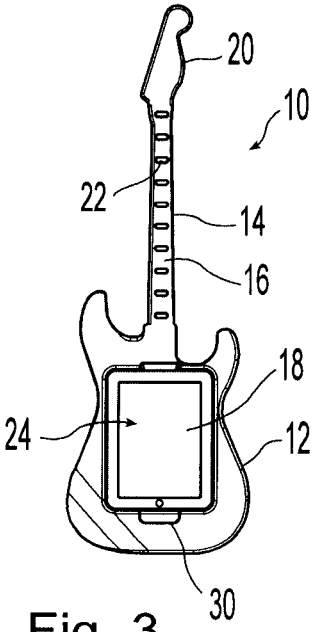
FIG. 3 is a frontal elevational view of the synthetic guitar.
Figure 5:
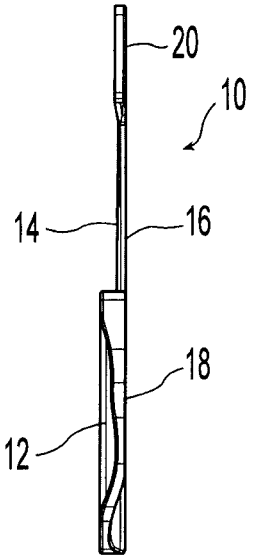
FIG. 5 is a right side elevational view of the synthetic guitar of FIGS. 1 to 4.
Figure 6:
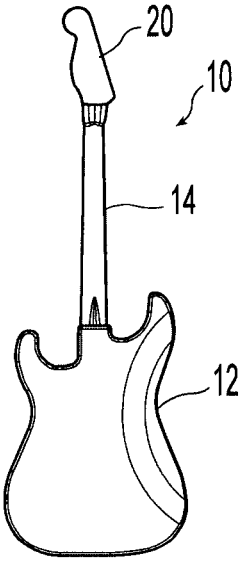
FIG. 6 is a rear elevational view of the synthetic guitar of FIGS. 1 to 6.
Figure 7:
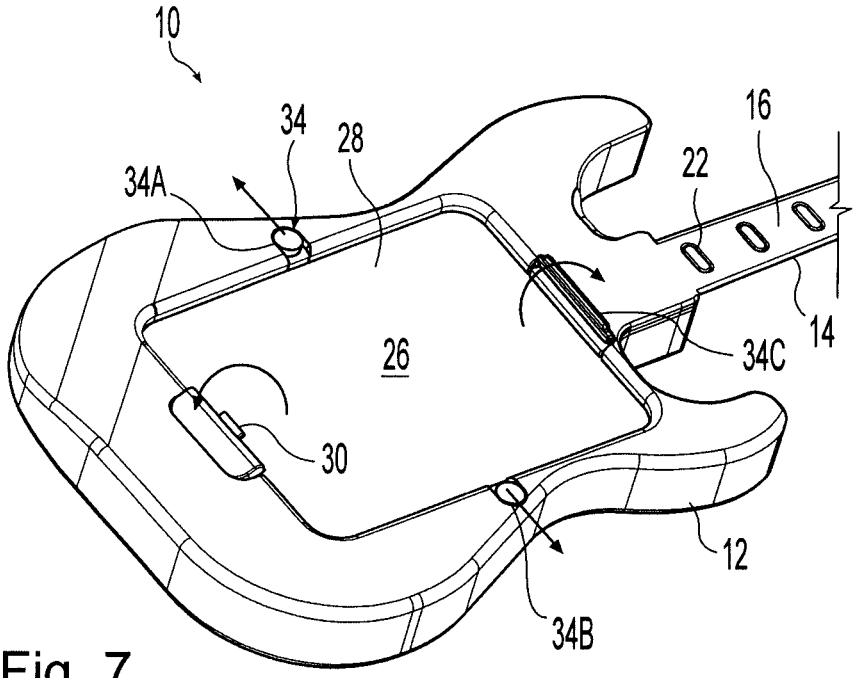
FIG. 7 is an enlarged fragmented perspective view of a portion the synthetic guitar of FIGS. 1 to 6, wherein the tablet computer is removed.
Figure 8:
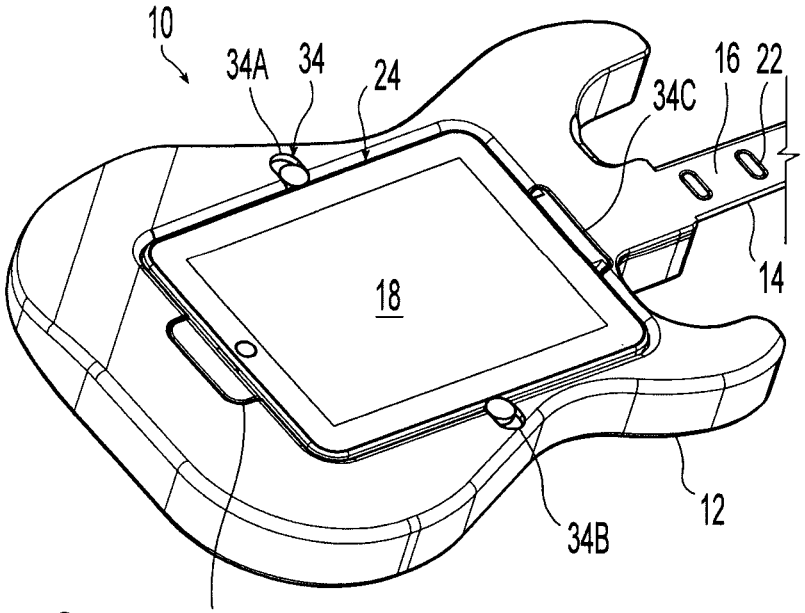
FIG. 8 is an enlarged fragmented perspective view similar to FIG. 7 but wherein the tablet computer is installed.

It should be understood that the appended drawings are not necessarily to scale, presenting a somewhat simplified representation of various preferred features illustrative of the basic principles of the invention. The specific design features of the synthetic guitars as disclosed herein, including, for example, specific dimensions, orientations, locations, and shapes of the various components, will be determined in part by the particular intended application and use environment. Certain features of the illustrated embodiments have been enlarged or distorted relative to others to facilitate visualization and clear understanding. In particular, thin features may be thickened, for example, for clarity or illustrations. All references to direction and position, unless otherwise indicated, refer to the orientation of the synthetic guitars illustrated in the drawings. In general, up or upward generally refers to an upward direction within the plane of the paper in FIG. 3 and down or downward generally refers to a downward direction within the plane of the paper in FIG. 3. Also in general, front or forward generally refers to a direction out the plane of the paper in FIG. 3 and rear or rearward generally refers to a direction into the plane of the paper in FIG. 3.

DETAILED DESCRIPTION OF CERTAIN PREFERRED EMBODIMENTS

It will be apparent to those skilled in the art, that is, to those who have knowledge or experience in this area of technology that many uses and design variations are possible for the electronic or synthetic guitars disclosed herein. The following detailed discussion of various alternative and preferred embodiments will illustrate the general principles of the invention. Other embodiments suitable for other applications will be apparent to those skilled in the art given the benefit of this disclosure.

Referring now to the drawings, FIGS. 1 to 8 show an electronic or synthetic guitar 10 according to a first embodiment of the present invention. The illustrated synthetic guitar 10 includes a body 12, a neck 14 extending from the body 12, at least one touch sensor 16 at a finger board portion of the neck 14 for indicating finger position of a user, a touch screen 18 at a sound board portion of the body 12 for indicating finger position of the user, and a processor receiving input signals from the at least one touch sensor 16 and the touch screen 18 and producing an output signal based at least partially on the input signals from the at least one touch sensor 16 and the touch screen 18.

The illustrated body 12 has generally planar front and back sides and a curved outer periphery. The illustrated outer periphery forms a traditionally shaped guitar body 12 but it is noted that any other suitable shape can be utilized. The body 12 is typically formed of wood but can alternatively be formed of any other suitable material such as for example, a plastic material.

The illustrated neck 14 is generally elongate and upwardly extends from the upper end of the body 12. The neck 12 forms a generally planar fret board portion at its forward side and has a head 20 located at its upper end which would be the location of tuners on a stringed guitar. The illustrated neck 14 forms a traditionally shaped guitar neck but it is noted that any other suitable shape can be utilized. The neck 14 is typically formed of wood but can alternatively be formed of any other suitable material such as, for example, a plastic material. The body 12 and the neck 12 together are configured as a typical guitar.

The illustrated touch sensor 16 is a single touch pad extending along the forward side of the neck 14 and facing forward to form the fret board having a plurality of frets. A plurality of laterally extending demarcations 22 is provided along the length of the touch pad to form the plurality of separate frets. The demarcations 22 can be marked onto the surface of the touch pad, indentations in the surface of the touch pad, protuberances from the surface of the touch pad, or any other suitable manner of establishing separate frets along the touch pad. The touch pad can be of any suitable type such that it indicates the finger position of the user by sending electronic signals as the user places their fingers along the fret board (that is, as the user's fingers engage the touch pad) to simulate pressing strings of a stringed guitar. It is noted that the touch sensor 16 can alternatively be a plurality of separate touch pads that form the plurality of frets. It is also noted that the touch sensor 16 can alternatively be an array of touch pads or touch switches where the array includes a plurality of rows of pads or switches to form the frets and each row has a plurality of pads or switches to form the "strings". It is further noted that any other suitable type of touch sensor 16 can alternatively be utilized.

The illustrated touch screen 18 is forward facing and located at a sound board area of the body 12 which is centrally located on the front side of the body 12. The touch screen 18 is for indicating finger position of the user by sending electronic signals as the user places their fingers along the sound board (that is, as the user's fingers engage the touch screen 18) to simulate strumming, plucking, tapping, or the like the strings of a stringed guitar. The touch screen 18 preferably used to display an image of a plurality of strings to visually simulate a stringed guitar at the sound board. The illustrated touch screen 18 is provided by a commercially available, off-the-shelf, tablet computer 24 which is removably secured to the body 12 as described in more detail hereinafter. The tablet computer 12 can be of any suitable type having a touch screen 18 and a general purpose processor capable of operating suitable software. A suitable tablet computer 24 is, for example, an iPad available from Apple Inc. of Cupertino, Calif.

The illustrated body 12 has a receptacle 26 for receiving and removably securing the tablet computer 24 to the body 12. The illustrated receptacle 26 is a recess or cavity 28 open at only its forward side and sized and shaped to closely receive the tablet computer 24 therein with the forward surface of the tablet computer 24, that is, the touch screen 18, generally flush with the forward surface of the body 12. That is, the depth of the cavity 28 is substantially equal to the depth of the tablet computer 24.

An electrical connector 30 is provided for electrically connecting the tablet computer 24 to the at least one touch sensor 16 and other electronic components as described in more detail herein below. The illustrated electrical connector 30 is an iPad dock connector (a 32 pin Apple, Inc. proprietary connector) but can alternatively be any other suitable type of connector depending on the specific tablet computer 24 that is to be utilized. The illustrated electrical connector 30 is located at the lower side of the cavity 28 to cooperate with an electrical connector 32 of the tablet computer 24 when the tablet computer 24 is located in the cavity 28. It is noted that the electrical connector 30 can be located at any other suitable location depending on the tablet computer 24 to be utilized. The illustrated connector 30 is pivotably connected to the body 12 such that the tablet computer 24 can first be connected to the electrical connector 30 and then pivoted into the cavity 28 about the pivot axis of the electrical connector 30.

At least one latch or lock 34 is provided for removably securing the tablet computer 24 in the receptacle 26. The illustrated receptacle 26 is provided with first and second latches 34A, 34B located at the left and right sides of the cavity 28 and a third latch 34C located at the upper side of the cavity 28 opposite the pivoting connector 30. The illustrated first and second latches 34A, 34B are sliding type latches that each laterally slide between a blocking position in which it blocks insertion and removal of the tablet computer 24 from the cavity 28 and an unblocking position in which it permits insertion and removal of the tablet computer 24 from the cavity 28. The illustrated third latch 34C is a pivoting type latch that pivots between a blocking position in which it blocks insertion and removal of the tablet computer 24 from the cavity 28 and an unblocking position in which it permits insertion and removal of the tablet computer 24 from the cavity 28. It is noted that any other suitable quantity or type of latches 34 can alternatively be utilized.

Figure 9:
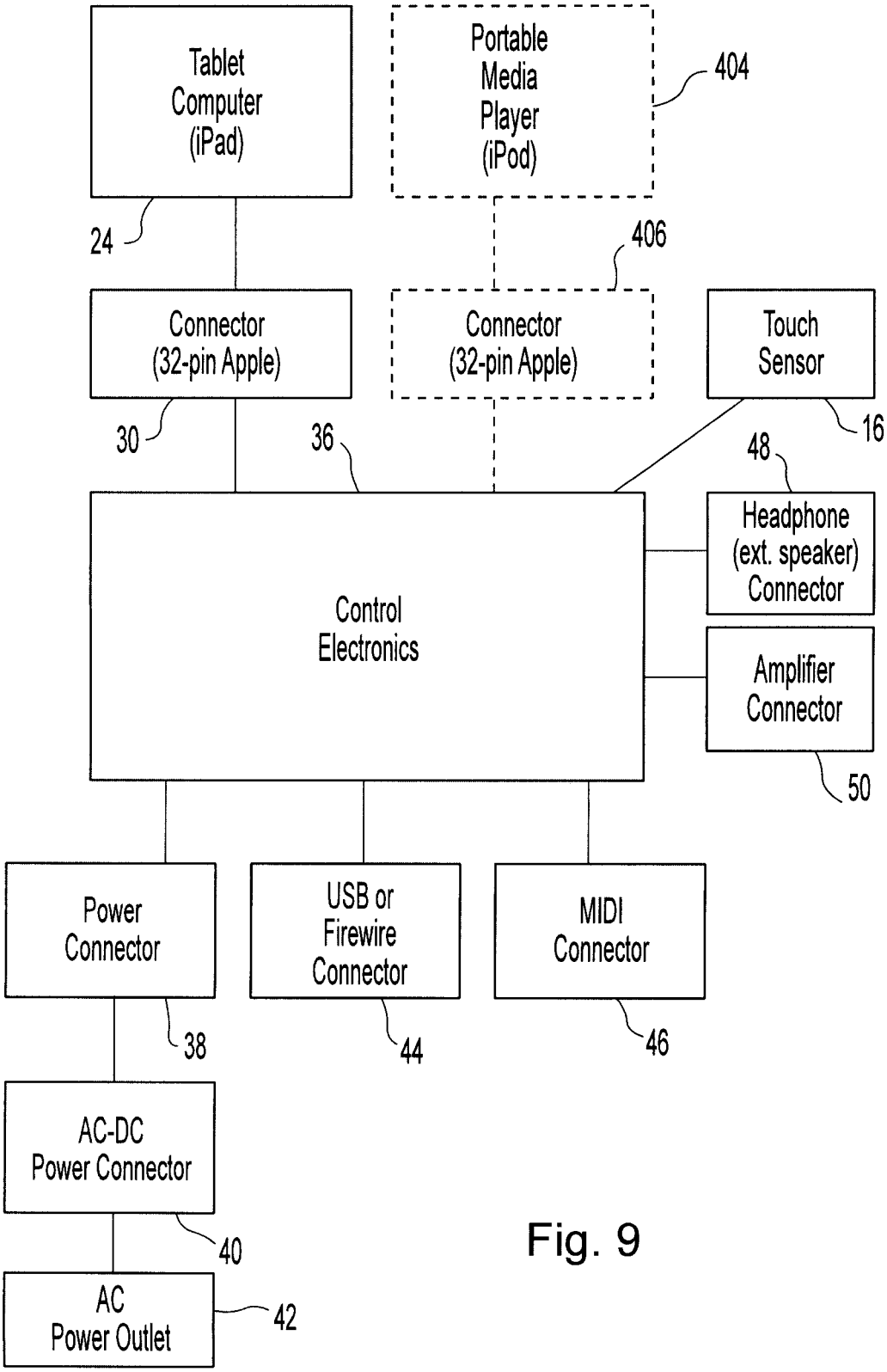
FIG. 9 is a diagrammatic view of electrical components of the synthetic guitar of FIGS. 1 to 8.
Figure 10:
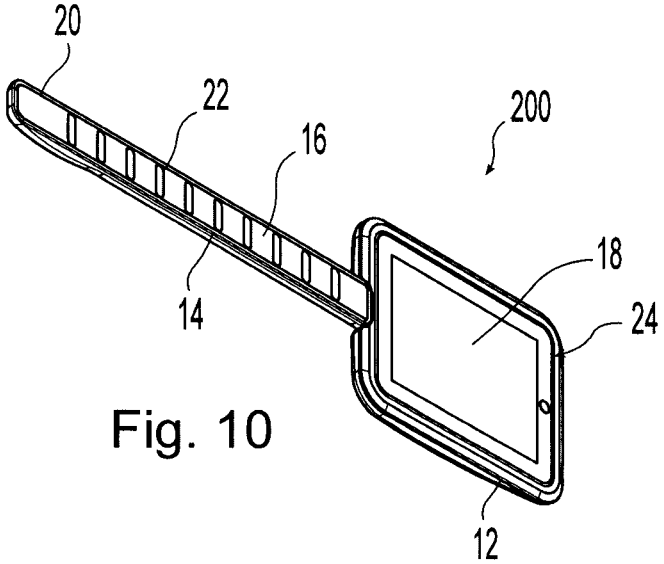
FIG. 10 is a perspective view of a synthetic guitar according to a second embodiment of the present invention.
Figure 11:
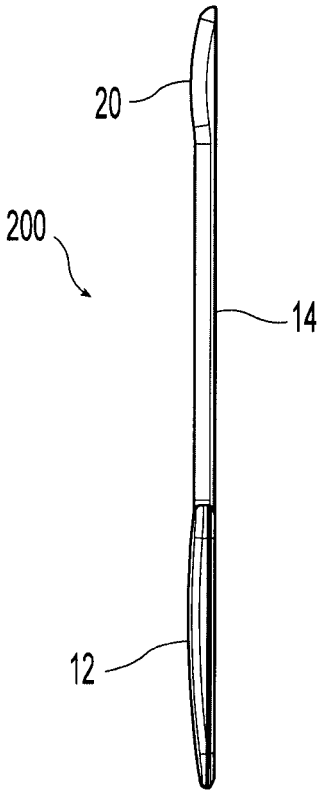
FIG. 11 is a right side elevational view of the synthetic guitar of FIG. 10.
Figure 12:
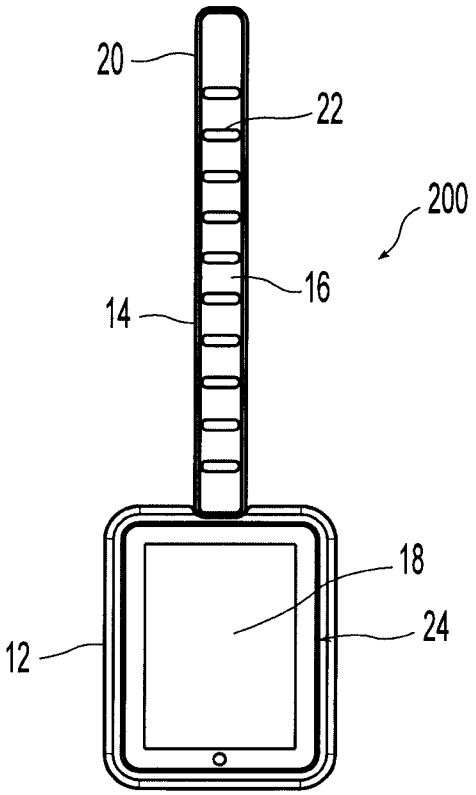
FIG. 12 is a front elevational view of the synthetic guitar of FIGS. 10 and 11.
Figure 13:
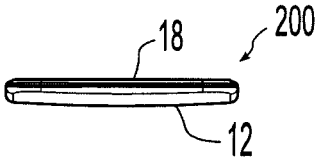
FIG. 13 is a bottom plan view of the synthetic guitar of FIGS. 10 to 12.

As best shown in FIG. 9, the electrical connector 30 is electrically connected to control electronics 36 of the synthetic guitar 10 to electrically connect the touch sensor 16 as well as other electric components to the tablet computer 24. A power connector 38 is preferably provided so that a suitable AC/DC power converter 40 can be connected an AC power source 42 to power the electrical components of the synthetic guitar 10. A USB or Firewire connector or the like 44 is preferably provided so that the tablet computer 24 can be connected to an external computer, video game console, or the like to either interact with such or be powered therefrom. A MIDI connector 46 is preferably provided so that the synthetic guitar 10 can be connected to any MIDI compatible equipment. An electrical jack 48 for a guitar amplifier is also preferably provided. It is noted that these electrical connectors 38, 44, 46, 48 can be utilized in any combination and/or any other suitable type of electrical connection can additionally be provided.

The memory and/or processor of the tablet computer 24 is provided with suitable software which graphically displays strings on the touch screen to visually simulate a stringed guitar which the user can serum, pick, or the like. The software can also display a whammy bar, volume control knob or any other desired element on the touch screen to visually simulate a stringed guitar. The software receives the input signals from the touch sensor 16 and the touch screen 18 and produces output signals based at least partially on the input signals from the at least one touch sensor 16 and the touch screen 18. The software can enable the synthetic guitar 10 to be used as a music synthesizer and provide a musical output signal that is sent to a tablet computer speaker, an external speaker or headphones, an external amplifier, an external MIDI capable component, an external computer, and/or any other suitable device. The software can have a midi output that can be used to create music and/or can permit playing along with music files located on the tablet computer 24. The software can additionally or alternatively enable the synthetic guitar 10 to be used as a video game controller or peripheral and provide an output signal to a video game console, external computer, or the like. The software application can also upload files to video games such as, for example, Guitar Hero, Second Life, etc. It is also noted that the software can also enable the synthetic guitar 10 to be used in any other desired manner.

FIGS. 10 to 13 illustrate a synthetic guitar 200 according to a second embodiment of the present invention. The synthetic guitar 200 according to the second embodiment of the invention is substantially the same as the synthetic guitar 10 according to the first embodiment described hereinabove. The synthetic guitar 200 according to the second embodiment of the invention illustrates that the body 12 and/or the neck 14 can have other suitable shapes. The illustrated body 12 is generally rectangular to closely match the tablet computer 24. The illustrated neck 14 has a head 20 that is an extension of the fret board portion of the neck (that is, has a thickness and width that matches the remainder of the neck 14). It is noted that the body 12 and the neck 14 can have any other suitable shape and size.

Figure 15:
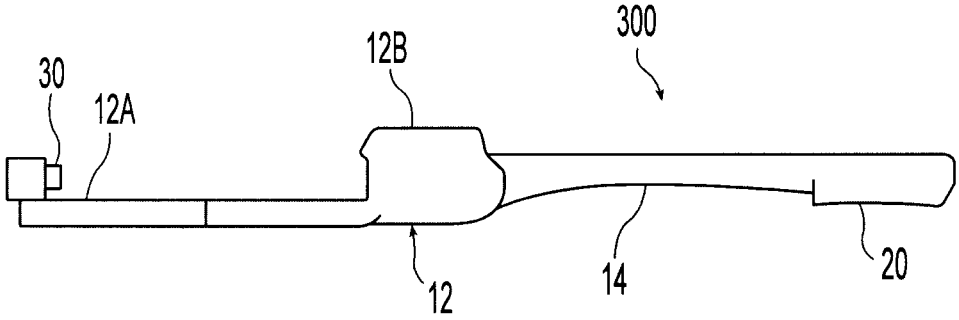
FIG. 15 is a left side elevational view of the synthetic guitar of FIG. 14.
Figure 14:
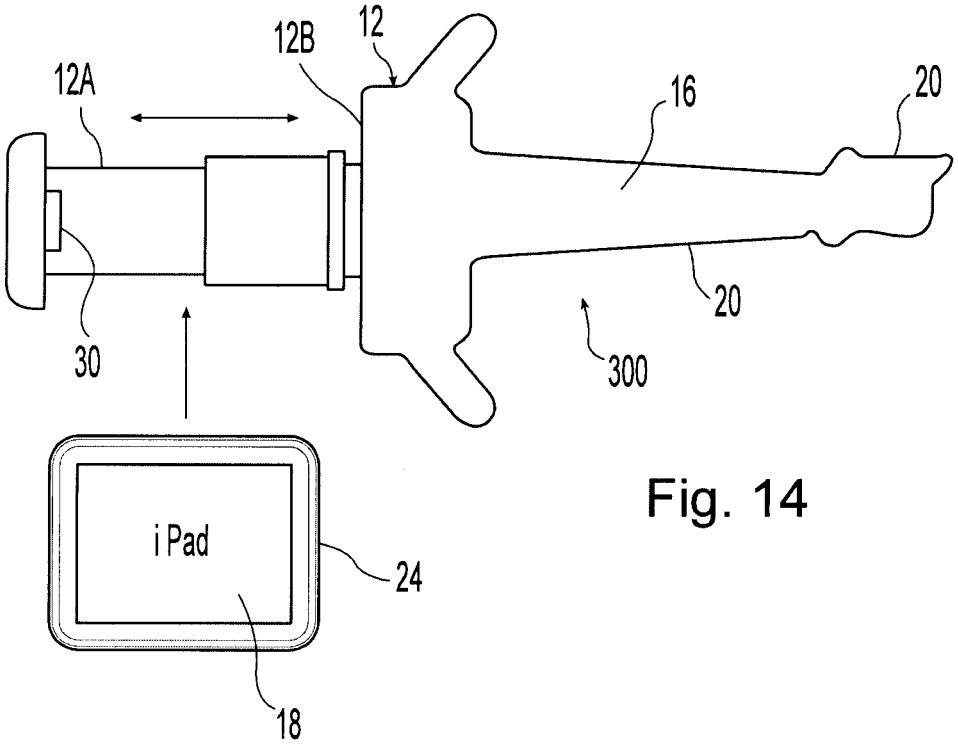
FIG. 14 is a partially exploded front elevational view of a synthetic guitar according to a third embodiment of the present invention.
Figure 16:
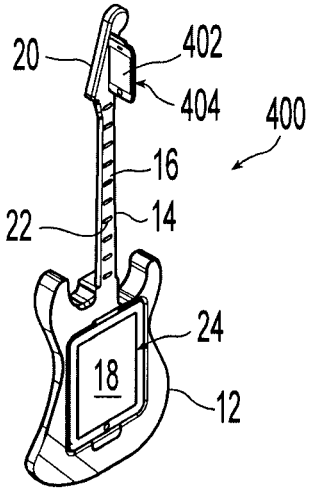
FIG. 16 is a perspective view of a synthetic guitar according to a fourth embodiment of the present invention.
Figure 17:
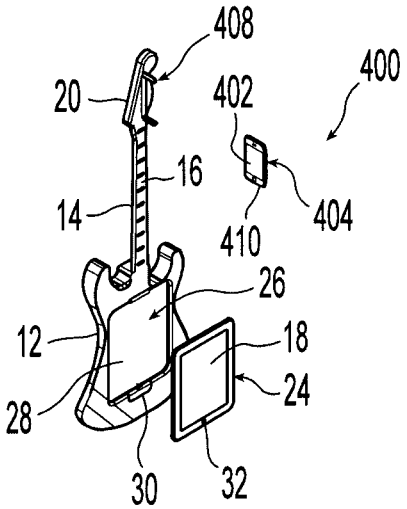
FIG. 17 is a partially-exploded view of the synthetic guitar of FIG. 16, wherein a tablet computer having a touch screen and a handheld portable media player are each removed.
Figure 19:
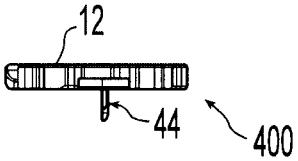
FIG. 19 is a top plan view of the synthetic guitar of FIGS. 16 to 18.
Figure 18:
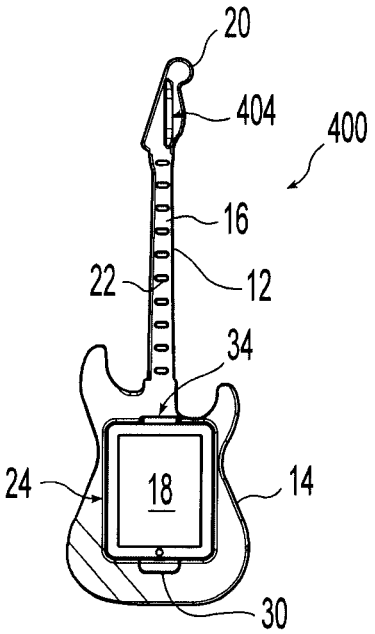
FIG. 18 is a front elevational view of the synthetic guitar of FIGS. 16 to 17.
Figure 20:
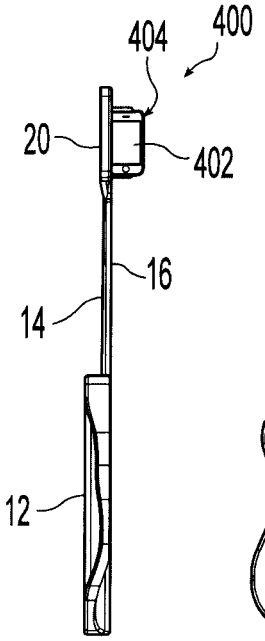
FIG. 20 is a right side elevational view of the synthetic guitar of FIGS. 16 to 19.
Figure 21:
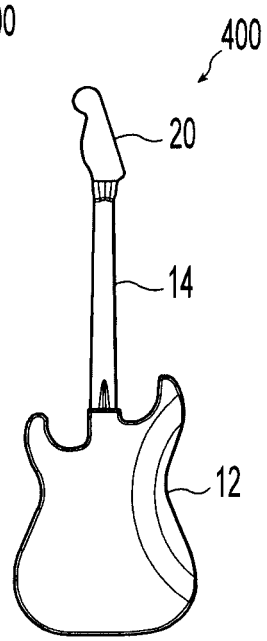
FIG. 21 is a rear elevational view of the synthetic guitar of FIGS. 16 to 20.

FIGS. 14 and 15 illustrate a synthetic guitar 300 according to a third embodiment of the present invention. The synthetic guitar 300 according to the third embodiment of the invention is substantially the same as the synthetic guitar 10 according to the first embodiment described herein above. The synthetic guitar 300 according to the third embodiment of the invention illustrates that that the body 12 can have other suitable shapes and that the receptacle 26 for the tablet computer 24 can have other forms. The illustrated receptacle 26 is formed by a two-piece body 12A, 12B. The illustrated body 12 comprises first and second telescoping portions 12A, 12B for inserting and removing the tablet computer 24 therebetween. When the first and second portions 12A, 12B are extended in the upper/lower direction, the tablet computer 24 can be inserted therebetween. When the first and second portions 12A, 12B are retracted with the tablet computer 24 therebetween, the tablet computer 24 is retained to the body 12. A suitable latch 34 is provided to removably secure the first and second portions 12A, 12B in the retracted configuration. It is noted that insertion axis of the electrical connector 30 extends in the same direction as the extension and retraction of the body portions 12A, 12B so that the tablet computer 24 is connected to the electrical connector 30 when the body portions 12A, 12B are retracted.

FIGS. 16 to 23 illustrate a synthetic guitar 400 according to a fourth embodiment of the present invention. The synthetic guitar 400 according to the fourth embodiment of the invention is substantially the same as the synthetic guitar 10 according to the first embodiment described hereinabove. The synthetic guitar 400 according the fourth embodiment of the invention illustrates that the synthetic guitar 400 can have an additional electronic display and/or input device 402. The illustrated additional electronic display 402 is located at the head 20 of the neck 14 and is oriented to face in a lateral direction substantially perpendicular to the touch screen 18 so that the electronic display 402 is visible to the user when playing the synthetic guitar 402. It is noted that the touch screen 18 may not be visible to the user when playing the synthetic guitar 10. It is also noted that the additional electronic display 402 can be alternatively located at any other suitable location and/or can be oriented in any other suitable orientation. The additional electronic display 402 can be used to display any suitable information to the user such as, for example, instructional information, gaming information, and/or music information. If the additional display 402 is also an input device, it can be used to select songs to play along with or games to be played so that the touch screen 18 of the tablet computer 24 does not have to be used for this purpose. The illustrated additional electronic display 402 is provided by an off-the-shelf, commercially available, hand-held portable media player 404 that is removably secured to the head 20 so that it can be used as both an additional display screen and an input device. The portable media player 404 can be of any suitable type having a display screen but preferably has a touch screen. A suitable portable media player 404 having a touch screen is, for example, an iPod Touch or iPhone both of which are available from Apple Inc. of Cupertino, Calif.

The electronic display 402 is in electrical communication with the control electronics 36 and the processor of the tablet computer 24. The illustrated synthetic guitar 400 has an electrical connector 406 provided for electrically connecting the portable media player 404 to the control electronics 36 and the tablet computer 24 (as shown in FIG. 9). The illustrated electrical connector 406 is an iPod dock connector (a 32 pin Apple proprietary connector) but can alternatively be any other suitable type of connector depending on the portable media player 404 that is to be utilized. The illustrated electrical connector 406 is located at the lower side of a receptacle or retainer 408 for the portable media player 406 to cooperate with an electrical connector 410 of the portable media player 404 when the portable media player 404 is located in the retainer 408. It is noted that the electrical connector 406 can be located at any other suitable location depending on the portable media player 404 to be utilized.

Figure 22:
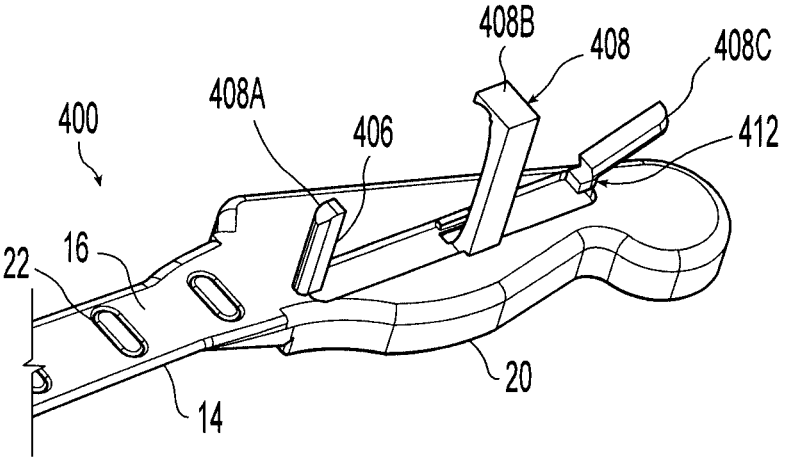
FIG. 22 is an enlarged fragmented perspective view of a portion the synthetic guitar of FIGS. 16 to 21, wherein the handheld portable media player is removed.
Figure 23:
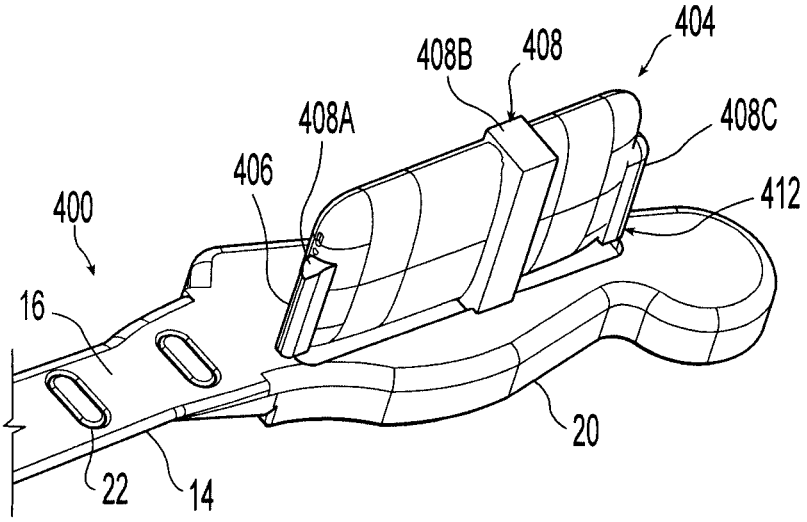
FIG. 23 is an enlarged fragmented perspective view similar to FIG. 22 but wherein the handheld portable media player is installed.
Figure 26:
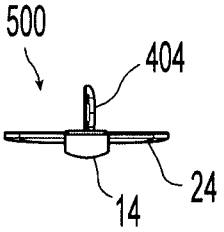
FIG. 26 is a top plan view of the synthetic guitar of FIGS. 24 and 25.
Figure 24:
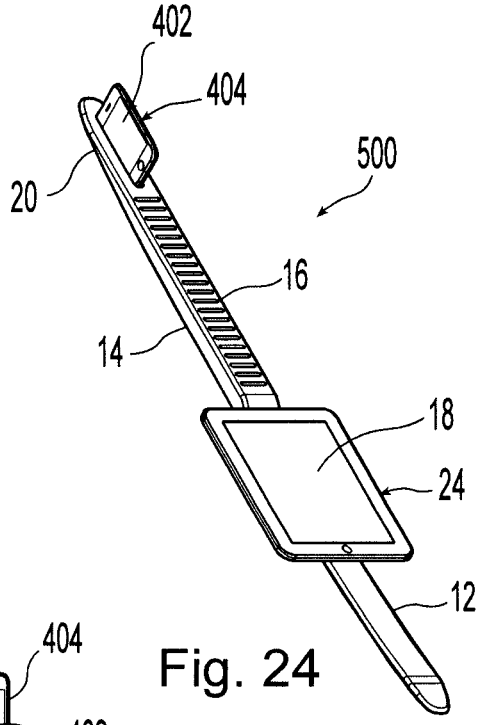
FIG. 24 is a perspective view of a synthetic guitar according to a fifth embodiment of the present invention.
Figure 25:
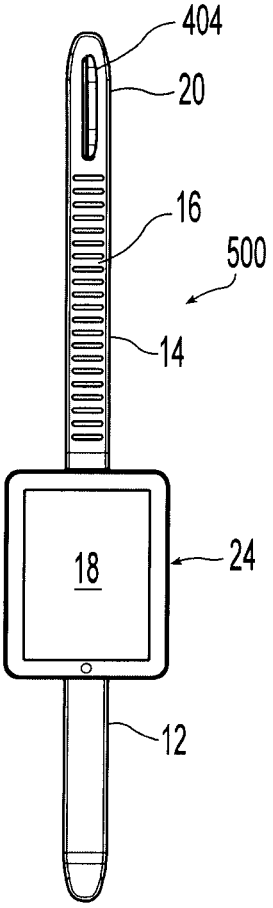
FIG. 25 is a front elevational view of the synthetic guitar of FIG. 24.
Figure 27:
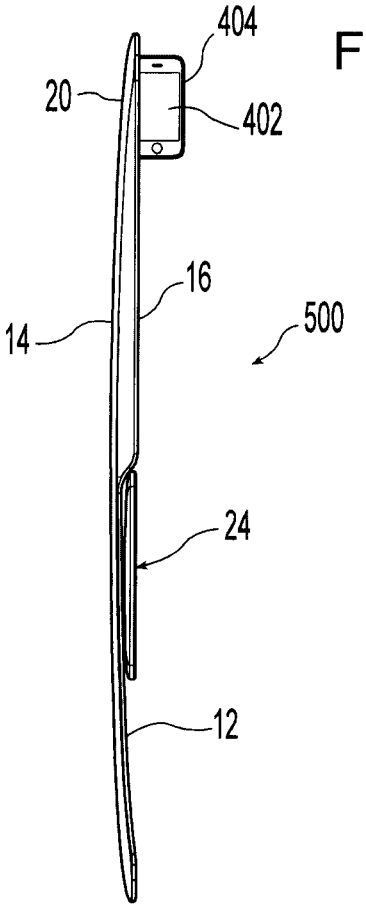
FIG. 27 is a right side elevational view of the synthetic guitar of FIGS. 24 to 26.
Figure 28:
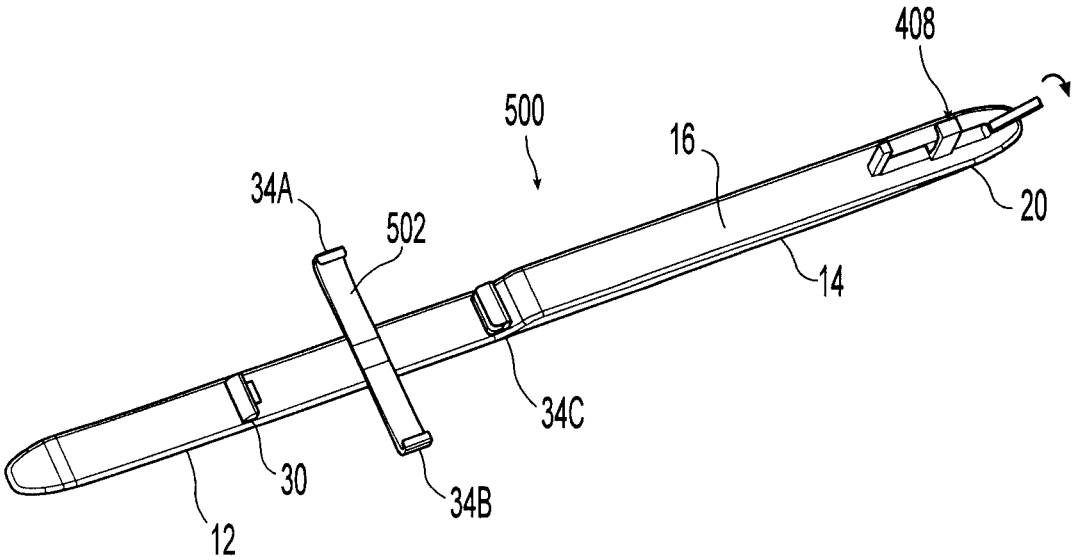
FIG. 28 is an enlarged perspective view the synthetic guitar of FIGS. 24 to 27, wherein the tablet computer and the handheld portable media player are each removed.
Figure 29:
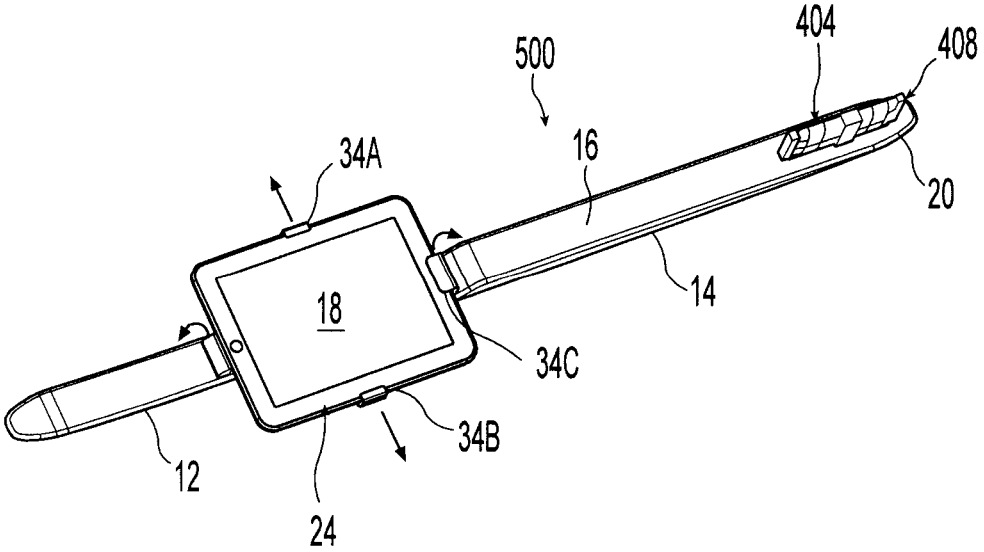
FIG. 29 is an enlarged perspective view similar to FIG. 28 but wherein the tablet computer and the handheld portable media player are each installed.

As best shown in FIGS. 22 and 23, the illustrated retainer 410 for the portable media player 404 includes a base member 408A, an intermediate member 408B, and a top member 408C which cooperates to secure the portable media player 404 to the head 20. The illustrated top member 408C is pivotably secured to the head 20 to form a latch 412 such that the portable media player 404 can be selectively inserted and removed from the retainer 408. It is noted that any other suitable type of latch 412 can alternatively be utilized. It is also noted that insertion axis of the electrical connector 406 extends in the same direction as the insertion direction of the portable media player 404 into the retainer 408 so that the portable media player 404 is connected to the electrical connector 406 when inserted into the retainer 408. It is further noted that any other suitable type of retainer 408 for the portable media player 404 can alternatively be utilized.

FIGS. 24 to 29 illustrate a synthetic guitar 500 according to a fifth embodiment of the present invention. The synthetic guitar 500 according to the fifth embodiment of the invention is substantially the same as the synthetic guitar 400 according to the fourth embodiment described hereinabove. The synthetic guitar 500 according to the fifth embodiment of the invention further illustrates that the body 12 and/or the neck 15 can have other suitable shapes and the receptacle 26 can have other suitable forms. The illustrated body 12 is generally an extension of the fret board portion of the neck 14 and the head 20 of the neck 14 is generally a further extension of the fret board portion of the neck 14 opposite the body 12. Arranged in this manner, the body 12 and neck 14 are generally narrow and elongated in a continuous manner. The illustrated receptacle 26 includes a cross member 502 laterally extending perpendicular to the main portion of the body 12 and has the first and second latches 34A, 34B at ends thereof.

Any of the features or attributes of the above described embodiments and variations can be used in combination with any other features and attributes of the above described embodiments and variations as desired.

It is apparent from the above detailed description of preferred embodiments of the present invention, that the synthetic guitars 10, 200, 300, 400, 500 of the present invention, provide a realistic playing experience and/or have relatively now production costs. Also apparent is that the use of a separate off-the-shelf tablet computer reduces the effective cost of the synthetic guitar to the user because the tablet compute is available for other uses.

From the foregoing disclosure and detailed description of certain preferred embodiments, it is also apparent that various modifications, additions and other alternative embodiments are possible without departing from the true scope and spirit of the present invention. The embodiments discussed were chosen and described to provide the best illustration of the principle of the present invention and its practical application to thereby enable one of ordinary sills in the art to utilize the invention in various embodiments and with various modifications as are suited to the particular use contemplated. All such modifications and variations are within the scope of the present invention as determined by the appended claims when interpreted in accordance with the benefit to which they are fairly, legally and equitable entitled.

The invention claimed is:

1. A musical instrument comprising:

a body having a forward surface and sidewalls extending from the forward surface to define a recess extending inwardly from the forward surface;

an extension extending from the body;

a touch sensor at the extension, the touch sensor being configured to sense a first finger position of a user;

an electrical circuit electrically coupled to the touch sensor and including a first electrical connector positioned in the recess; and a computer removably secured in the recess of the body, the computer having a housing, a general purpose processor secured within the housing, a touch screen configured to sense a second finger position of the user, and a second electrical connector removably electrically connected to the first electrical connector.

2. The musical instrument according to claim 1, wherein the processor of the computer is configured to receive input signals from the touch sensor and the touch screen and produce a musical output signal based at least partially on the input signals from the touch sensor and the touch screen.

3. The musical instrument according to claim 1, further comprising at least one mechanism configured to removably secure the computer within the recess of the body, the at least one mechanism releasably contacting the housing of the computer.

4. The musical instrument according to claim 1, wherein the body has a recessed surface defining a back side of the recess and the housing of the computer includes a back surface that contacts the recessed surface of the body.

5. The musical instrument according to claim 1, wherein the first electrical connector is a pivoting electrical connector secured to the body.

6. The musical instrument according to claim 1, wherein the body comprises first and second telescoping portions configured to receive and enable removal of the computer.

7. The musical instrument according to claim 1, wherein the extension includes a neck and a head located opposite to the body with respect to the neck.

8. The musical instrument according to claim 7, wherein the extension includes a forward facing fret board, the musical instrument further comprising an electronic display at the head, spaced from the fret board, and facing in a lateral direction substantially perpendicular to the touch screen of the computer.

9. The musical instrument according to claim 8, wherein the electronic display is a portable media player removably secured to the head.

10. The musical instrument according to claim 8, wherein the electronic display is electrically coupled by the electrical circuit to the computer.

11. The musical instrument according to claim 1, wherein the computer is configured to display on the touch screen a volume controller that enables the user to control a volume of sound output by the musical instrument.

12. The musical instrument according to claim 1, wherein the computer is configured to display virtual strings on the touch screen, the touch screen being configured to indicate finger positions of a user by sending electronic signals as the user places fingers along the touch screen to simulate strumming, plucking, tapping, or the like of strings of a stringed instrument.

13. A musical instrument device for use with a computer having a processor and a touch screen, the musical instrument device comprising:

a body having a forward surface and sidewalls extending from the forward surface to define a recess extending inwardly from the forward surface, the recess configured to receive the computer;

an extension extending from the body;

a touch sensor at the extension, the touch sensor being configured to sense a first finger position of a user; and an electrical circuit electrically coupled to the touch sensor and including a first electrical connector positioned in the recess and configured to releasably electrically connect to a second electrical connector of the computer.

14. The musical instrument device according to claim 13, further comprising at least one mechanism configured to releasably secure the computer within the recess, wherein the at least one mechanism is configured to releasably contact the computer.

15. The musical instrument device according to claim 14, wherein the first electrical connector is pivotably secured to the body.

16. The musical instrument device according to claim 13, wherein the body comprises first and second telescoping portions configured to receive and enable removal of the computer.

17. The musical instrument device according to claim 13, wherein the extension includes a neck extending from the body and a head located opposite the body with respect to the neck.

18. The musical instrument device according to claim 17, wherein the neck includes a forward facing fret board, the synthetic guitar further comprising an electronic display at the head, spaced from the fret board, and facing in a direction transverse to the fret board.

19. The musical instrument device according to claim 17, wherein the head has a receptacle configured to removably secure a portable media player, the receptacle being spaced from the fret board and facing in a lateral direction substantially perpendicular to the fret board.

20. The musical instrument device according to claim 19, wherein the receptacle includes a third electrical connector configured to electrically connect the portable media player to the computer via the electrical circuit.

21. A synthetic musical instrument for use with a computer having a processor and a touch screen, the synthetic musical instrument comprising:

a body having a forward surface;

an extension extending from the body;

a touch sensor at the extension, the touch sensor being configured to sense a first finger position of a user;

an electrical circuit electrically coupled to the touch sensor and including a first electrical connector configured to releasably electrically connect to a second electrical connector of the computer; and at least one mechanism configured to releasably secure the computer to the body.

22. The synthetic musical instrument according to claim 21, wherein:

the extension includes a neck extending from the body and a head located opposite the body with respect to the neck, the head having a retainer configured to removably secure a display device; and the electrical circuit includes a third electrical connector configured to electrically connect the display device to the computer.

23. The synthetic musical instrument according to claim 21, further comprising the computer removably secured to the body, the computer having a housing, wherein the processor is a general purpose processor secured within the housing, the touch screen is configured to sense a second finger position of the user, and the second electrical connector is removably electrically connected to the first electrical connector.

24. The synthetic musical instrument according to claim 22, wherein the computer is configured to display on the touch screen a volume controller that enables the user to control a volume of sound output by the musical instrument.

25. A musical instrument device for use with a computer having a processor and a touch screen, the musical instrument device comprising:

a body having first and second telescoping portions, the first telescoping portion configured to extend into an extended configuration that allows the computer to be inserted between the first and second telescoping portions and to retract into a retracted configuration to retain the computer between the first and second telescoping portions;

an extension extending from the body;

a touch sensor at the extension, the touch sensor being configured to sense a first finger position of a user; and an electrical circuit electrically coupled to the touch sensor and including a first electrical connector configured to releasably electrically connect to a second electrical connector of the computer.

26. The musical instrument device according to claim 25, comprising:

a latch configured to removably secure the first and second portions in the retracted configuration.

27. A synthetic musical instrument for use with a computer having a processor and a touch screen, the synthetic musical instrument comprising:

a body including a front face and a receptacle configured to receive the computer;

a touch sensor at the extension, the touch sensor being configured to sense a first finger position of a user;

an extension extending from the body and including a head spaced apart from the body, the head having a retainer configured to removably secure a display device and position the display device in an orientation that is transverse with respect to the front face of the body; and an electrical circuit electrically coupled to the touch sensor and including a first electrical connector configured to releasably electrically connect to a second electrical connector of the computer, the electrical circuit including a third electrical connector configured to electrically connect to the display device.

28. The synthetic musical instrument according to claim 27, wherein the display device includes an input device configured to enable a user to input information into the input device.

* * * * *